US012588745B2

(12) United States Patent
Wei

(10) Patent No.: US 12,588,745 B2
(45) Date of Patent: Mar. 31, 2026

(54) ROLLER STRUCTURE WITH ADJUSTABLE DIAMETER AND HAIR-TANGLING PREVENTION FUNCTION, AND HAIR CURLER THEREOF

(71) Applicant: Shenzhen Fenda Technology Co., Ltd., Shenzhen (CN)

(72) Inventor: Mianjia Wei, Shenzhen (CN)

(73) Assignee: Shenzhen Fenda Technology Co., Ltd., Shenzhen (CN)

( * ) Notice: Subject to any disclaimer, the term of this patent is extended or adjusted under 35 U.S.C. 154(b) by 128 days.

(21) Appl. No.: 18/602,440

(22) Filed: Mar. 12, 2024

(65) Prior Publication Data

US 2024/0389728 A1 Nov. 28, 2024

(30) Foreign Application Priority Data

May 25, 2023 (CN) ..... 202321315002.0

(51) Int. Cl.
*A45D 2/36* (2006.01)

(52) U.S. Cl.
CPC ..... *A45D 2/367* (2013.01)

(58) Field of Classification Search
CPC . A45D 2/02; A45D 2/14; A45D 2/146; A45D 2/36; A45D 2/362; A45D 2/367; A45D 2002/025
See application file for complete search history.

(56) References Cited

U.S. PATENT DOCUMENTS

2021/0235833 A1* 8/2021 Rao ..... A45D 1/04

* cited by examiner

*Primary Examiner* — Rachel R Steitz
(74) *Attorney, Agent, or Firm* — Hemisphere Law, PLLC

(57) ABSTRACT

Disclosed is a roller structure with an adjustable diameter and a hair-tangling prevention function, including an end support and at least two heat conduction plates, where the end support is connected to end parts of the heat conduction plates, and a plurality of the heat conduction plates can be all moved radially relative to the end support in a radial direction of the end support; and the roller structure further includes a hair-tangling prevention member arranged on a periphery of a gap where the heat conduction plates are connected with the end support. Therefore, the roller structure can effectively prevent the hair filaments from being inserted into the gap of the roller structure, thereby improving the styling experience, efficiency and effect. A hair curler including the roller structure is further disclosed in the present disclosure.

11 Claims, 7 Drawing Sheets

ROLLER STRUCTURE WITH ADJUSTABLE DIAMETER AND HAIR-TANGLING PREVENTION FUNCTION, AND HAIR CURLER THEREOF

TECHNICAL FIELD

The present disclosure relates to the technical field of hairdressing, and particularly relates to a roller structure with an adjustable diameter and a hair-tangling prevention function, and a hair curler thereof.

BACKGROUND ART

A hair curler is a handheld electronic product used for curling hair, and its main components include a grip and a heating roller. To design the hair curler, a circuit panel is adopted to control a temperature thereof, the heating roller is made of a tourmaline ceramic panel, which can evenly disperse heat, circulate heating, improve a protein structure of hair, and protect the hair during the curling process. When in use, a user can wind the hair that needs to be styling in a single or multiple turns around the heating roller, and then turn on the heating.

Since a heating roller arranged on a traditional hair curler is fixed in the shape, diameter and other parameters when it leaves from the factory and a user cannot change these diameters, resulting in hair curls with a same curvature radius and a single shape, without variations and layering, thereby leading to poor aesthetic appearance. Therefore, a patent with the publication number CN218127340U, provided by the applicant of the present disclosure, discloses a hair curler and a roller with an adjustable diameter, where a diameter of hair curling is adjustable.

However, in the course of increasing a diameter of the roller of the hair curler by moving each of a plurality of heat conduction plates radially outwards, a thin slit at the junction of an adjustment knob and the heat conduction plates are exposed, making hair filaments easy to be inserted into the thin slit, thereby reducing the styling experience, efficiency and effect.

SUMMARY

In order to overcome the defects in the prior art, a first objective of the present disclosure is to provide a roller structure with an adjustable diameter and a hair-tangling prevention function, which can effectively prevent hair filaments from being inserted into a thin slit thereof, thereby improving the styling experience, efficiency and effect.

A second objective of the present disclosure is to provide a hair curler.

The first objective of the present disclosure is implemented through the following technical solution:

a roller structure with an adjustable diameter and a hair-tangling prevention function, including an end support and at least two heat conduction plates, where the end support is connected to end parts of the heat conduction plates, and the plurality of heat conduction plates can be all moved radially relative to the end support in a radial direction of the end support; and the roller structure with an adjustable diameter and a hair-tangling prevention function further includes a hair-tangling prevention member, where the hair-tangling prevention member is arranged on a periphery of a gap where the heat conduction plates are connected with the end support.

Further, the hair-tangling prevention member is arranged on the heat conduction plates and extends in an axial direction near the end support to surround the periphery of the gap; and the hair-tangling prevention member and the heat conduction plates are formed separately.

Further, the hair-tangling prevention member is arranged on the end support and extends in an axial direction near the heat conduction plates to surround the periphery of the gap; and the hair-tangling prevention member and the end support are formed separately.

Further, an end surface of each of the heat conduction plates is located between opposite ends of the hair-tangling prevention member.

Further, the hair-tangling prevention member is provided with a radial extension portion, and the radial extension portion is located at a circumferential slit where the two adjacent heat conduction plates are circumferentially joined.

Further, avoidance spaces for accommodating the radial extension portion are formed on the end support.

Further, a side of the hair-tangling prevention member adjacent to the end support is fitted with the end support.

Further, the number of the end support is two, and the two end supports are respectively connected to two ends of one heat conduction plate; and one of the end supports is a grip, and the other end support is an adjustment knob.

Further, an outer side surface of the adjustment knob is of a cambered surface structure.

The second objective of the present disclosure is implemented through the following technical solution:

a hair curler, including the roller structure with an adjustable diameter and a hair-tangling prevention function.

Compared with the prior art, the present disclosure has the following beneficial effects:

each heat conduction plate is connected with the hair-tangling prevention member through the end portion close to the end support; and since the hair-tangling prevention member is arranged on the periphery of the gap where the heat conduction plates are connected with the end support, when the plurality of heat conduction plates are moved linearly in synchronism in the radial direction of the structure of the end portion to enlarge the curling diameter of a hair curler, hair filaments cannot be directly inserted into the gap, but have to bypass the blockage of the hair-tangling prevention member to enter the gap in a polyline or an arc-shaped path, which greatly increases the difficulty of inserting the hair filaments into the gap. Therefore, the roller structure with an adjustable diameter and a hair-tangling prevention function can effectively prevent the hair filaments from being inserted into the gap of the roller structure, thereby improving the styling experience, efficiency and effect.

Figure 1:
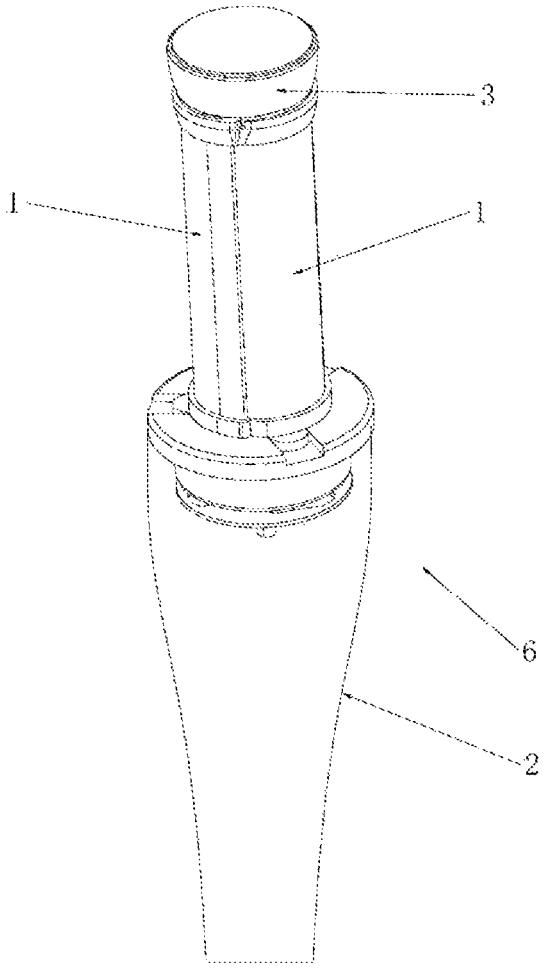
FIG. 1 is a structural schematic diagram of a hair curler according to the present disclosure.

In the drawings: 1. heat conduction plate; 11. hair-tangling prevention member; 12. radial extension portion; 2. grip; 3. adjustment knob; 31. avoidance space; 32. upper fixing base; 321. upper sliding hole; 33. upper rotating piece; 331. upper arc hole; 4. gap; 5. circumferential slit; 6. hair curler; 71. fixing column; 72. rotatable shaft; 73. upper guide rod; 74. lower fixing piece; and 75. lower rotating piece.

DETAILED DESCRIPTION OF THE EMBODIMENTS

The present disclosure will be further described below in conjunction with the accompanying drawings and specific embodiments. It should be noted that various embodiments or various technical features described below, without conflict there between, can be arbitrarily combined to form new embodiments.

It should be noted that if an element is considered to be "fixed to" the other element, it means that the element may be directly on the other element or indirectly on the other element, or intervening elements may also be present. When an element is considered to be "connected" to another element, the element may be directly connected to another element or there may be an intermediate element simultaneously. The terms "vertical," "horizontal," "left," "right," and the like as used herein are for illustrative purposes only and do not represent the only embodiments.

Unless otherwise defined, all technical and scientific terms mentioned herein have the same meaning as commonly understood by those skilled in the technical field of the present disclosure. The terms used in the specification of the present disclosure herein are just for the purpose of describing particular embodiments, and are not intended to limit the present disclosure. As used herein, the term "and/or" includes any and all combinations of one or more relevant listed items.

Figure 2:
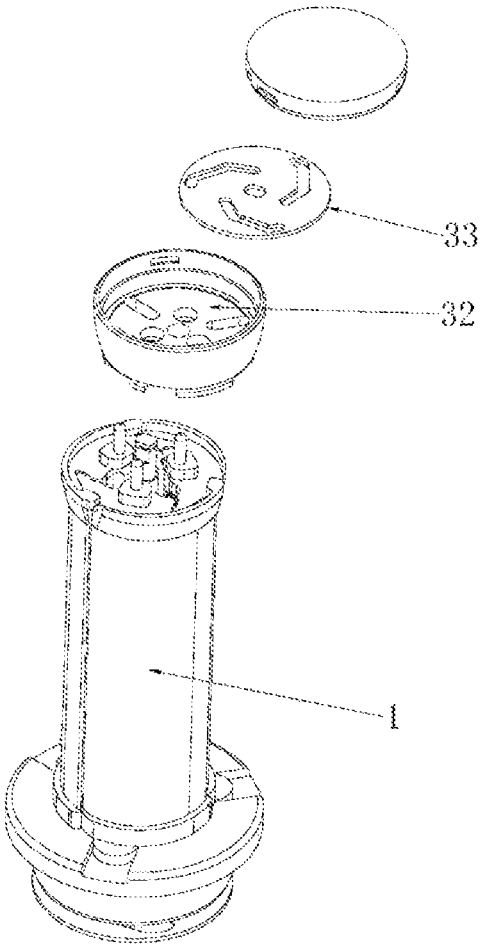
FIG. 2 is a structural schematic diagram of a roller structure with an adjustable diameter and a hair-tangling prevention function in FIG. 1.
Figure 3:
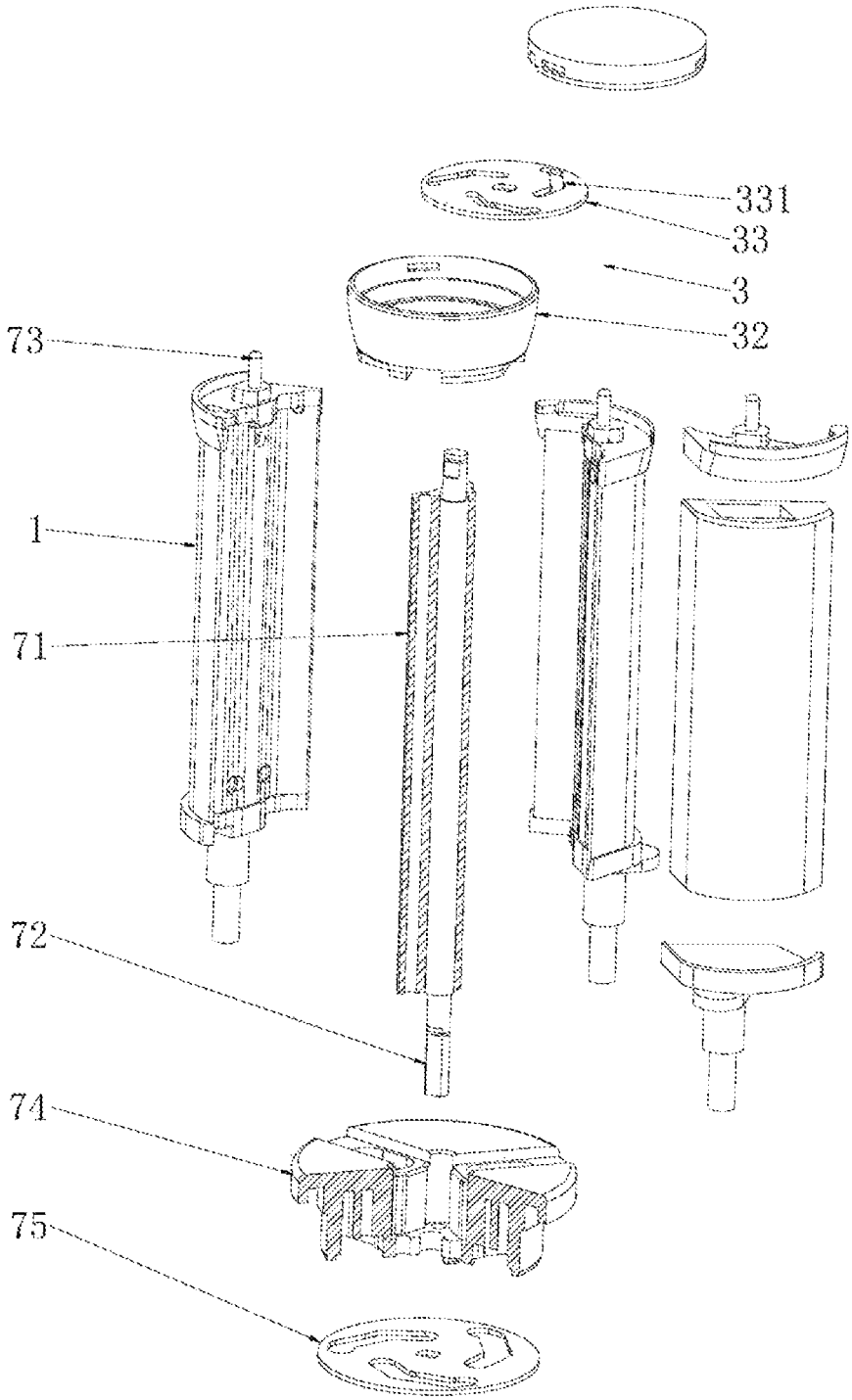
FIG. 3 is an exploded view of FIG. 2.
Figure 4:
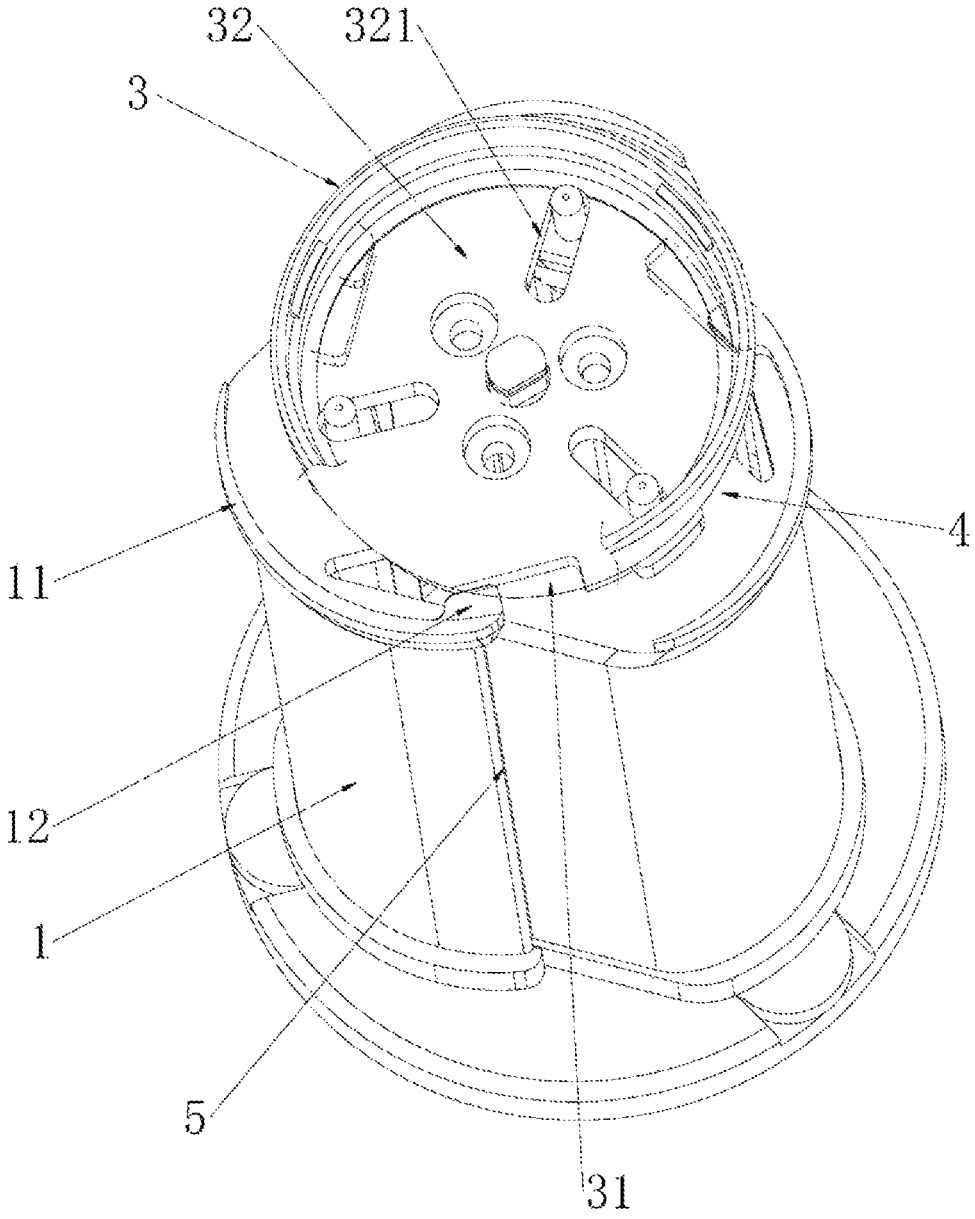
FIG. 4 is an effect diagram of FIG. 3 with part of a housing of an adjustment knob hidden.
Figure 5:
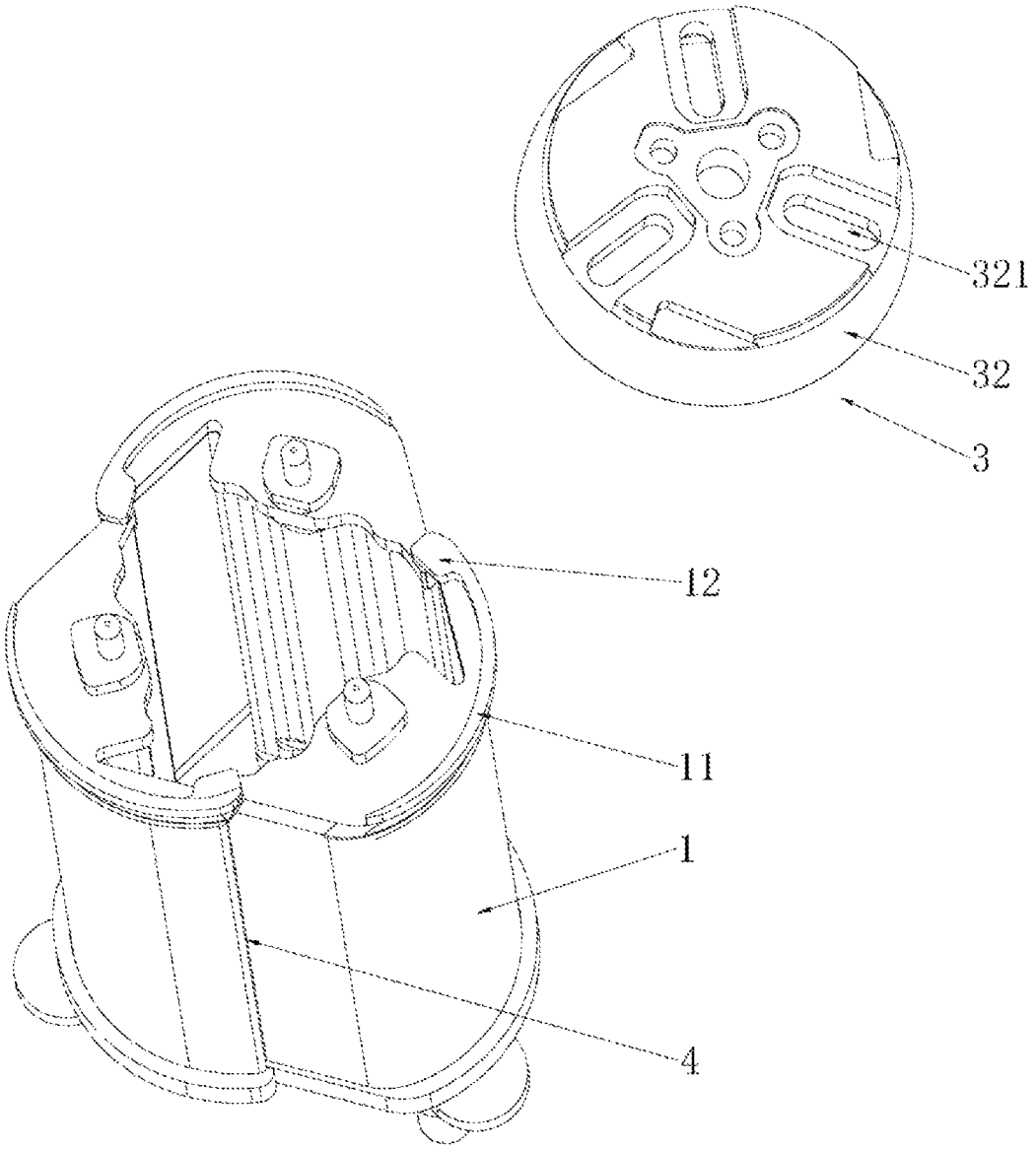
FIG. 5 is an exploded view of FIG. 4.
Figure 6:
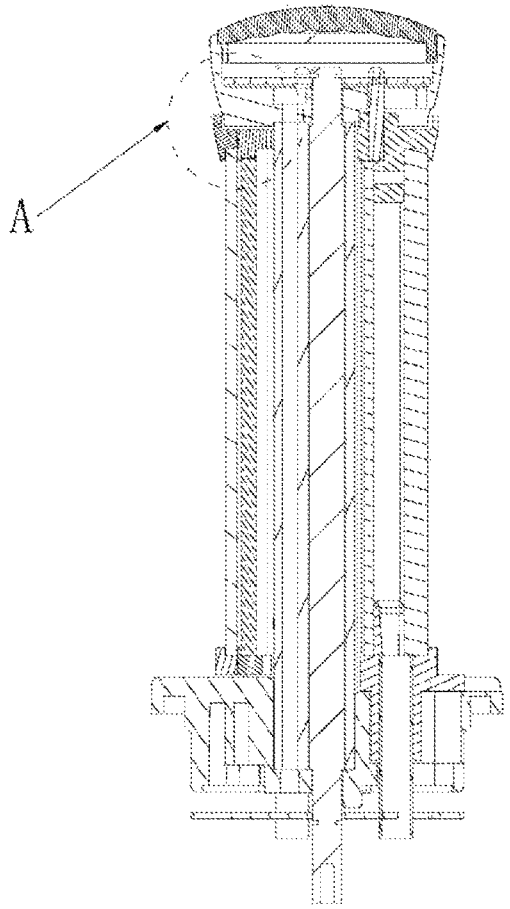
FIG. 6 is a cross-sectional view of FIG. 2.
Figure 7:
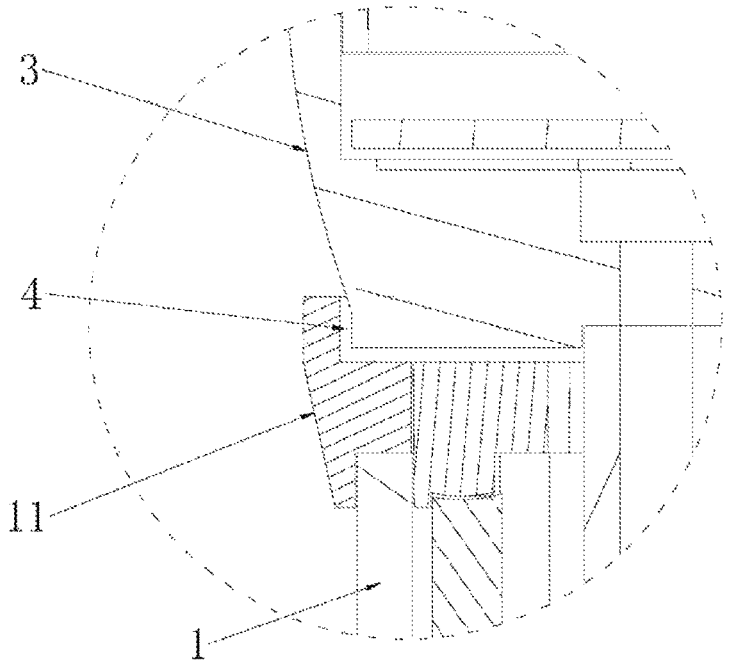
FIG. 7 is a partial enlarged view of A in FIG. 6.
Figure 8:
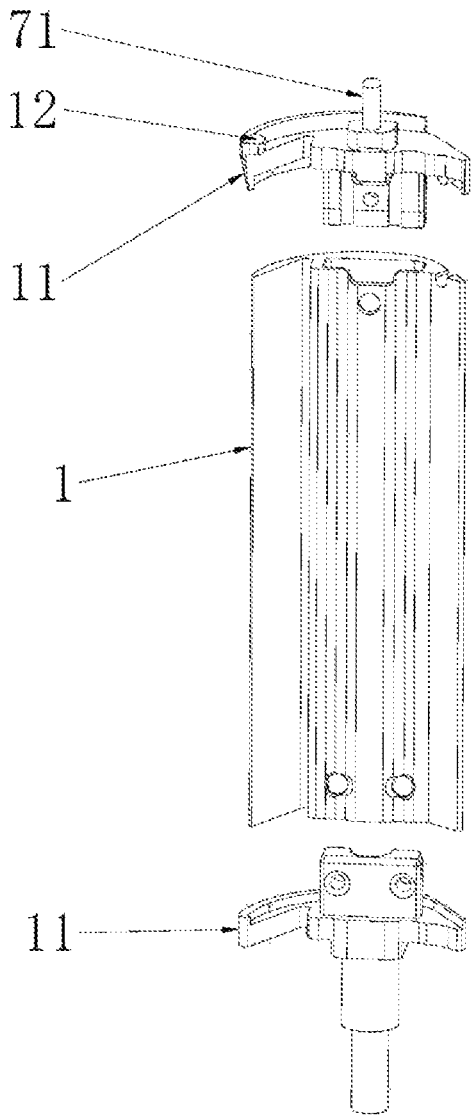
FIG. 8 is an exploded view of the cross-sectional view of FIG. 2.

FIGS. 1-8 show a roller structure with an adjustable diameter and a hair-tangling prevention function, according to a preferred embodiment of the present disclosure, including an end support and at least two heat conduction plates 1 connected to the end support, where the end support can be a grip 2 or an adjustment knob 3, a plurality of heat conduction plates 1 can be all moved radially relative to the end support in a radial direction of the end support, so as to adjust a diameter of hair curling of the roller structure with an adjustable diameter and a hair-tangling prevention function, and two adjacent heat conduction plates 1 always form a closed curve in a circumferential direction throughout diameter adjustment process (preferably forming an overlapping covered area). Importantly, the roller structure with an adjustable diameter and a hair-tangling prevention function further includes a hair-tangling prevention member 11, where the hair-tangling prevention member 11 is arranged on a periphery of a gap 4 where the heat conduction plates 1 are connected with the end support.

It can be understood that the hair-tangling prevention member 11 can be arranged either on the heat conduction plates 1 or on the end support. Therefore, two arrangement methods are provided. For the first arrangement method (this embodiment will be described in detail below through the first arrangement method): the hair-tangling prevention member 11 is arranged on the heat conduction plates 1 and extends in an axial direction near the end support, so as to surround the periphery of the gap 4; and in order to facilitate separate injection molding, the hair-tangling prevention member 11 and the heat conduction plates 1 are formed separately. For the second arrangement method: the hair-tangling prevention member 11 is arranged on the end support and extends in an axial direction near the heat conduction plates 1, so as to surround the periphery of the gap 4; and in order to facilitate separate injection molding, the hair-tangling prevention member 11 and the end support are formed separately.

Specifically, the working principle of the present disclosure is the same as that disclosed in a patent with the publication number CN 218127340U (which discloses a hair curler 6 and a roller with an adjustable diameter): the plurality of heat conduction plates 1 are distributed in a circumferential direction of the end support, and each heat conduction plate 1 can be moved linearly in synchronism in a radial direction of a structure of an end portion to create the effects of synchronous gathering and synchronous expansion.

Apparently, each heat conduction plate 1 is connected with the hair-tangling prevention member 11 through the end portion close to the end support; and since the hair-tangling prevention member 11 is arranged on the periphery of the gap 4 where the heat conduction plates 1 are connected with the end support, when the plurality of heat conduction plates 1 are moved linearly in synchronism in the radial direction of the structure of the end portion to enlarge the curling diameter of a hair curler 6, hair filaments cannot be directly inserted into the gap 4, but have to bypass the blockage of the hair-tangling prevention member 11 to enter the gap 4 in a polyline or an arc-shaped path, which greatly increases the difficulty of inserting the hair filaments into the gap 4. As a result, the roller structure with an adjustable diameter and a hair-tangling prevention function can effectively prevent the hair filaments from being inserted into the gap 4 of the roller structure, thereby improving the styling experience, efficiency and effect. Particularly, in this embodiment (that is, the hair-tangling prevention member 11 is arranged on the heat conduction plates 1), referring to FIG. 7, when the diameter of hair curling of the hair curler 6 is close to the minimum, a distance between the hair-tangling prevention member 11 and the gap 4 is closer and is almost fitted, making it more difficult for the hair filaments to be inserted into the gap 4; and in such case, a radial dimension of the end support can be smaller.

Based on the above description, in order to facilitate injection molding to reduce costs, the hair-tangling prevention member 11 and the heat conduction plates 1 are formed separately in this embodiment. Specifically, the hair-tangling prevention member 11 is detachably connected to the end portion of the heat conduction plate 1, in such case, in order to prevent the hair filaments from being inserted into the gap 4 along the junctions between the heat conduction plates 1 and the hair-tangling prevention member 11, and an end surface of each of the heat conduction plates 1 is located between opposite ends of the hair-tangling prevention member 11, such that a top and a bottom of the hair-tangling prevention member 11 can be covered by extending a height of the hair-tangling prevention member.

Further, since the two adjacent heat conduction plates 1 are each provided with a hair-tangling prevention member 11, the hair-tangling prevention member 11 is preferably further provided with a radial extension portion 12, so as to prevent the hair filaments from being inserted in a circumferential slit 5 between the two adjacent hair-tangling prevention members 11, and the radial extension portion 12 is located at the circumferential slit 5 where the two adjacent heat conduction plates 1 are circumferentially joined. Preferably, each radial extension portion 12 is arranged on one of the hair-tangling prevention members 11, in such case, hair-tangling prevention members 11 are of the same construction, thereby reducing the injection molding costs.

In this embodiment, when the end support is the adjustment knob 3, a plurality of avoidance spaces 31 are formed on the end support, and each radial extension portion 12 is accommodated in one of the avoidance spaces 31, such that the radial extension portion 12 is capable of being closing to the end support, thereby further increasing the difficulty of inserting the hair filaments into the circumferential slit 5.

Preferably, a side of the hair-tangling prevention member 11 adjacent to the end support is fitted with the end support, such that when the diameter of hair curling of the hair curler 6 is the smallest, it is difficult for the hair filaments to inserted into the gap 4. When the diameter of hair curling of the hair curler 6 is the largest, the hair filaments can be inserted into the gap 4 only along a side profile structure path of the end support, which is also very difficult.

Preferably, the number of the end support is two, and the two end supports are respectively connected to two ends of one heat conduction plate 1; and one of the end supports is a grip 2 and the other end support is an adjustment knob 3, such that the stability of controlling the plurality of heat conduction plates 1 is improved, that is, a top of the heat conduction plate 1 is connected to the adjustment knob 3, the bottom of the heat conduction plate 1 is connected to the grip 2, such that a top and a bottom of the heat conduction plate 1 can be synchronously moved in a radial direction of the hair curler 6 through linkage between the adjustment knob 3 and the grip 2.

Preferably, an outer side surface of the adjustment knob 3 is of a cambered surface structure, such that a side surface of the adjustment knob 3 is further fitted with the hair-tangling prevention member 11, which further increases the difficulty of inserting the hair filaments into the gap 4.

Preferably, the heat conduction plates 1 are distributed in a circumferential direction of the end support and can each be moved synchronously in their respective radial directions, and an outer side surface of each of the heat conduction plates 1 is always enclosed throughout the movement stroke to form a curved surface for winding the hair filaments, and the curved surface structure is more beneficial to styling.

The present disclosure further discloses the hair curler 6, and the hair curler 6 includes the roller structure with an adjustable diameter and a hair-tangling prevention function. Similarly, the adjustment knob 3 is connected to a driving assembly, and obviously, an upper fixing base 32 and the upper rotating piece 33 are arranged on the adjustment knob 3, an upper sliding hole 321 is formed on the upper fixing base 32, and an upper arc hole 331 is formed on the upper rotating piece 33. The driving assembly mainly includes a fixed column 71, a rotatable shaft 72 and an upper guide rod 73. Further, the grip 2 of the hair curler 6 is provided with a lower fixing piece 74 and a lower rotating piece 75. To avoid redundant description, a connection structure of the driving assembly of the hair curler 6 can be adaptively combined according to the connection method of a hair curler 6 and a roller with an adjustable diameter disclosed in the patent with the publication number CN 218127340U.

The above embodiments are merely preferred embodiments of the present disclosure and cannot be used to limit the scope of protection of the present disclosure, and any non-substantial variations and substitutions made by those skilled in the art on the basis of the present disclosure shall fall within the scope of protection claimed by the present disclosure.

What is claimed is:

1. A roller structure with an adjustable diameter and a hair-tangling prevention function, comprising an end support and at least two heat conduction plates (1), wherein the end support is connected to end parts of the heat conduction plates (1), and a plurality of the heat conduction plates (1) can be all moved radially relative to the end support in a radial direction of the end support; and the roller structure with an adjustable diameter and a hair-tangling prevention function further comprises a hair-tangling prevention member (11), wherein the hair-tangling prevention member (11) is arranged on a periphery of a gap (4) at which the heat conduction plates (1) are connected with the end support, and the hair-tangling prevention member (11) is disposed between the end support and the heat conduction plates (1); and wherein the hair-tangling prevention member (11) is provided with a plurality of radial extension portions (12) protruding from an outer wall of the roller structure to a center of the roller structure, and each of the plurality of radial extension portions (12) is located at a circumferential slit (5) at which the two adjacent heat conduction plates (1) are circumferentially joined to prevent hair filaments from inserting into the circumferential slit (5); and a plurality of avoidance spaces (31) are defined on a bottom end of the end support facing towards the heat conduction plates (1) along a circumferential direction of the end support, and the plurality of radial extension portions (12) are accommodated in the plurality of avoidance spaces (31) respectively to make the plurality of radial extension portions (12) closer to the end support.

2. The roller structure with an adjustable diameter and a hair-tangling prevention function according to claim 1, wherein the hair-tangling prevention member (11) is arranged on the heat conduction plates (1) and extends in an axial direction near the end support to surround the periphery of the gap (4); and the hair-tangling prevention member (11) and the heat conduction plates (1) are formed separately.

3. The roller structure with an adjustable diameter and a hair-tangling prevention function according to claim 1, wherein the hair-tangling prevention member (11) is arranged on the end support and extends in an axial direction near the heat conduction plates (1) to surround the periphery of the gap (4); and the hair-tangling prevention member (11) and the end support are formed separately.

4. The roller structure with an adjustable diameter and a hair-tangling prevention function according to claim 2, wherein an end surface of each of the heat conduction plates (1) is located between opposite ends of the hair-tangling prevention member (11).

5. The roller structure with an adjustable diameter and a hair-tangling prevention function according to claim 1, wherein a side of the hair-tangling prevention member (11) adjacent to the end support is fitted with the end support.

6. The roller structure with an adjustable diameter and a hair-tangling prevention function according to claim 1, wherein the number of the end support is two, and the two end supports are respectively connected to two ends of one heat conduction plate (1); and one of the end supports is a grip (2), and the other end support is an adjustment knob (3).

7. The roller structure with an adjustable diameter and a hair-tangling prevention function according to claim 6, wherein an outer side surface of the adjustment knob (3) is of a cambered surface structure.

8. A hair curler (6), comprising the roller structure with an adjustable diameter and a hair-tangling prevention function according to claim 1.

9. The roller structure with an adjustable diameter and a hair-tangling prevention function according to claim 1, wherein an outer edge of the hair-tangling prevention member (11) extends downward and upward in a length direction of the roller structure to cover at least a part of side walls of the heat conduction plates (1) and at least a part of a side wall of the end support.

10. A roller structure with an adjustable diameter and a hair-tangling prevention function, comprising:

at least two heat conduction plates (1);

an adjustment knob (3), connected to an end of each of the at least two heat conduction plates (1); and a hair-tangling prevention member (11), disposed between the at least two heat conduction plates (1) and the adjustment knob (3), and configured to prevent hair filaments from inserting into a gap (4) between the at least two heat conduction plates (1) and the adjustment knob (3);

wherein the hair-tangling prevention member (11) is provided with a plurality of radial extension portions (12) protruding from an outer wall of the roller structure to a center of the roller structure, and the radial extension portion (12) is located at a circumferential slit (5) at which adjacent two of the at least two heat conduction plates (1) are circumferentially joined to prevent the hair filaments from inserting into the circumferential slit (5); and a plurality of avoidance spaces (31) are defined on a bottom end of the adjustment knob (3) facing towards the heat conduction plates (1) along a circumferential direction of the adjustment knob (3), and the plurality of radial extension portions (12) are accommodated in the plurality of avoidance spaces (31) respectively to make the plurality of radial extension portions (12) closer to the adjustment knob (3).

11. The roller structure with an adjustable diameter and a hair-tangling prevention function according to claim 10, wherein an outer edge of the hair-tangling prevention member (11) extends downward and upward in a length direction of the roller structure to cover at least a part of side walls of the at least two heat conduction plates (1) and at least a part of a side wall of the adjustment knob (3).

* * * * *